United States Patent [19]

Miller et al.

[11] 4,444,425

[45] Apr. 24, 1984

[54] CYLINDRICAL OBJECT RECOVERY DEVICE

[75] Inventors: Donald Miller, Del Mar; Clark A. Bowers, San Diego, both of Calif.

[73] Assignee: The United States of America as represented by the Secretary of the Navy, Washington, D.C.

[21] Appl. No.: 298,700

[22] Filed: Sep. 2, 1981

[51] Int. Cl.[3] ..... B66C 3/16

[52] U.S. Cl. ..... 294/88

[58] Field of Search ..... 294/88, 86 R, 83 R, 294/103, 104, 106, 66 R, 118, 119; 414/1

[56] References Cited

U.S. PATENT DOCUMENTS 3,198,568 8/1965 Mindrum ..... 294/88

3,363,929 1/1968 Nelson ..... 294/88

*Primary Examiner*—James B. Marbert

*Attorney, Agent, or Firm*—Robert F. Beers; Ervin F. Johnston

[57] ABSTRACT

A grabber type cylindrical object recovery apparatus is provided wherein the grabber has a U-shaped frame which is curved substantially 180°. A pair of curved pads are provided wherein each pad is pivoted to a lower extremity of a respective leg of the U-shaped frame. The inside of the curves of the pads face inwardly with respect to the U-shaped frame for movement between grabbing and releasing positions with respect to the cylindrical object. In the releasing position a top portion of each pad extends slightly into an open area within the frame so as to be located for forcible engagement with a top portion of the cylindrical object and then pivotal movement for the grabbing position when the object is encompassed by the U-shaped frame. In the grabbing position the bottom portion of each pad extends the curve of the respective leg beyond the 180° of the frame so as to engage a bottom portion of the cylindrical object for retention purposes. A pair of locking devices is provided wherein each locking device is mounted to the frame for locking a respective pad alternately in its releasing position or its grabbing position. The locking devices are responsive to the forcible engagement of the cylindrical object with the pads to change the locking devices from a locked released position of the pads to a locked grabbing position of the pads.

10 Claims, 10 Drawing Figures

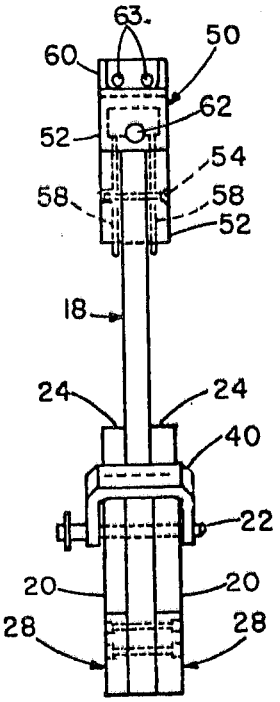
FIG. 3
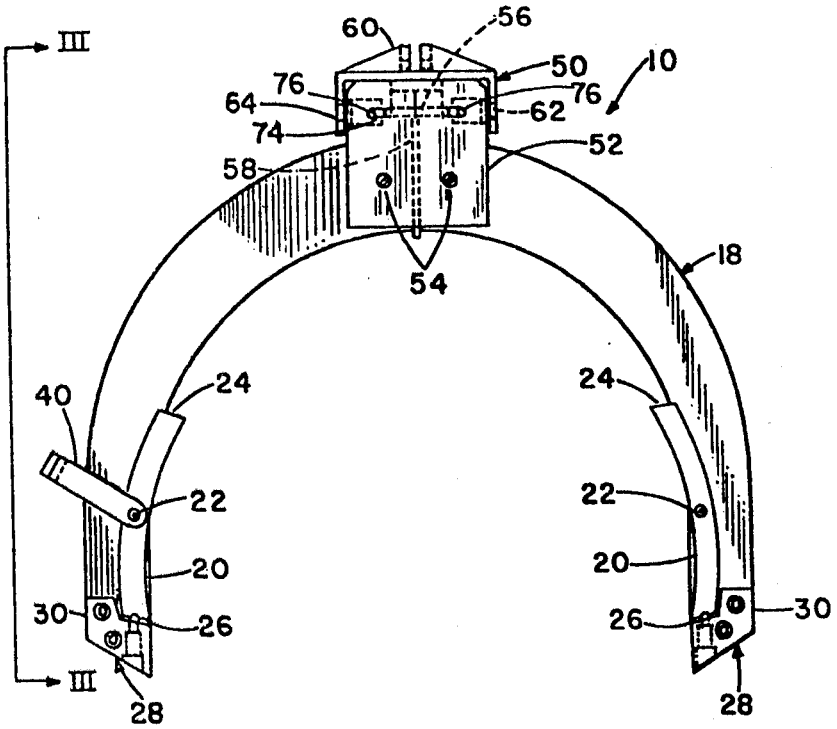
FIG. 2 (RELEASING POSITION)
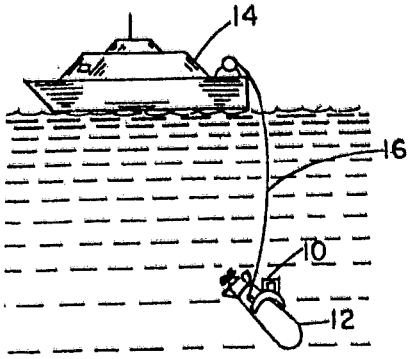
FIG. 1
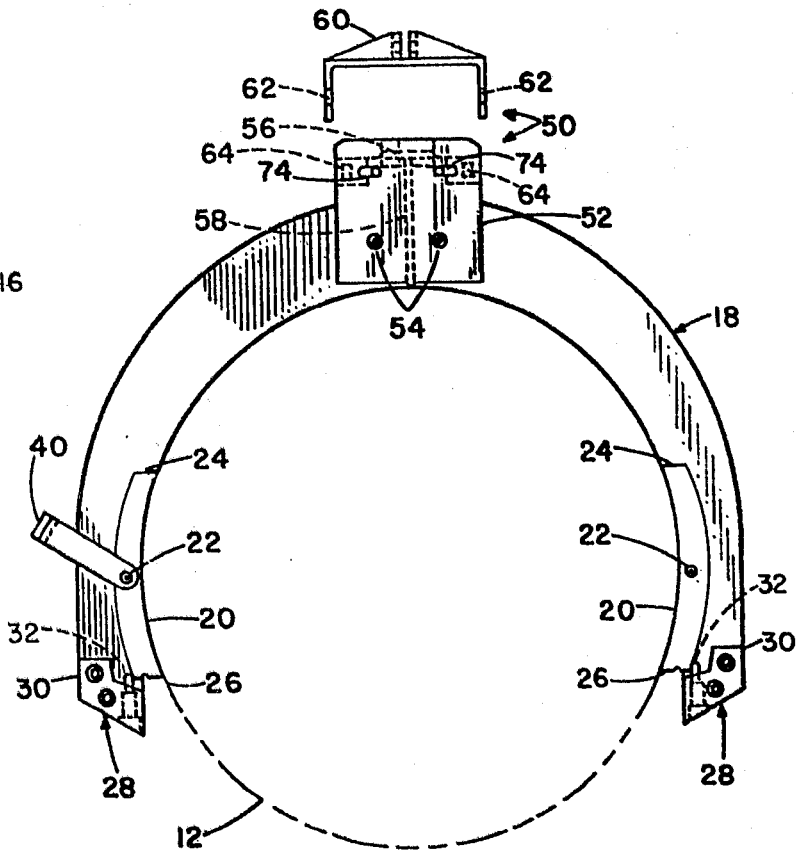
FIG. 4 (GRABBING POSITION)

CYLINDRICAL OBJECT RECOVERY DEVICE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The U.S. Navy is heavily involved in ocean salvage operations, particularly the recovery of test torpedoes which lay on the ocean floor. The primary method of recovery is the use of a tethered underwater vehicle which has manipulator arms for grabbing the test torpedo. The underwater vehicle is controlled by an operator on a surface ship. With a television network the operator can move the underwater vehicle in position so that the manipulator arms can be utilized to grab the torpedo. The underwater vehicle is then raised so as to bring the test torpedo to the surface ship for ultimate recovery.

The use of manipulator arms on tethered underwater vehicles has been effective, however, the manipulator arms have to be moved separately from the underwater vehicle in order to grab a test torpedo. There has been a need for an improved grabbing device which can be utilized by mere placement about the test torpedo, and which is compatible with other methods of deployment, such as use by divers or by manned underwater vehicles.

SUMMARY OF THE INVENTION

The present invention provides a grabber type cylindrical object recovery apparatus which overcomes the problems associated with the prior art devices and methods of recovery. The present apparatus includes a U-shaped frame which is curved substantially 180°. A pair of curved pads are provided wherein each pad is pivoted to a lower extremity of a respective leg of the U-shaped frame. The inside of the curves of the pads face inwardly with respect to the U-shaped frame for movement between grabbing and releasing positions with respect to the cylindrical object. In the releasing position a top portion of each pad extends slightly into the open area within the U-shaped frame so as to be located for forcible engagement with a top portion of the cylindrical object and thence pivotal movement to the grabbing position. In the grabbing position a bottom portion of each pad extends the curve of the respective leg beyond the 180° of the frame so as to engage a bottom portion of the cylindrical object for retention purposes. A pair of locking devices are provided wherein each locking device is mounted to the frame for locking a respective pad alternately in its releasing position or its grabbing position. The locking devices are responsive to the forcible engagement of the cylindrical object with the pads to change the locking device from a locked released position of the pads to a locked grabbing position of the pads. With this arrangement the recovery apparatus can be made much smaller in size and lighter in weight. Further, the recovery apparatus is simpler to use and is more adaptable with various methods of deployment. The apparatus need merely be placed over the cylindrical object and it operates automatically to grab and retain the object for recovery purposes.

OBJECTS OF THE INVENTION

An object of the present invention is to provide a grabber type cylindrical object recovery apparatus which overcomes the problems associated with prior art recovery apparatuses.

Another object is to provide a grabber type cylindrical object recovery apparatus which is smaller in size and simpler to operate than prior art recovery apparatuses.

A further object is to provide a recovery apparatus which can be utilized to automatically grab a cylindrical object merely by pressing the apparatus against the object.

Still another object is to provide a recovery apparatus which can be utilized to simultaneously grab a cylindrical object and be released from a holder when the recovery apparatus is pressed against the cylindrical object.

Yet another object is to provide a recovery apparatus which is compatible with various methods of deployment for grabbing a cylindrical object in the ocean by merely pressing the apparatus against the cylindrical object.

Other objects, advantages and novel features of the invention will become apparent from the following detailed description of the invention when considered in conjunction with the accompanying drawings.

BRIEF DESCRIPTION OF THE DRAWINGS

FIG. 1 is an ocean elevation view of the present cylindrical object recovery apparatus wherein a torpedo is retained for recovery by personnel on a surface ship.

FIG. 2 is a side view of the cylindrical object recovery apparatus in a releasing position.

FIG. 3 is an end view of the cylindrical object recovery apparatus taken along plane III—III of FIG. 2.

FIG. 4 is a side view of the cylindrical object recovery apparatus in a grabbing position.

DESCRIPTION OF THE PREFERRED EMBODIMENT

Figure 5:
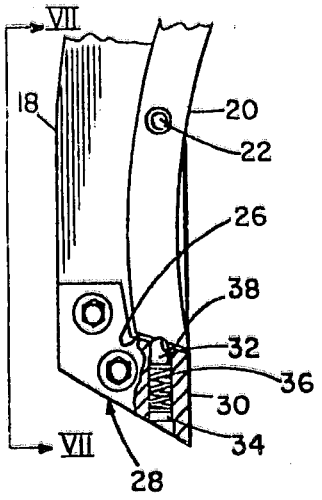
FIG. 5 is an enlarged side view of a bottom portion of one of the legs of the recovery apparatus with a portion cut away to show a locking device locking a pad in a releasing position.

Referring now to the drawings wherein like reference numerals designate like or similar parts throughout the several views, there is illustrated in FIG. 1 a cylindrical object recovery apparatus 10 which has been operated to grab a torpedo 12 on the floor of the ocean for recovery by personnel on a surface ship 14. A line 16 may be connected to the recovery apparatus 10 in order to raise the torpedo 12 to the surface ship.

GRABBING MECHANISM

As illustrated in FIG. 2, the cylindrical object recovery apparatus 10 includes a U-shaped frame 18 which is curved substantially 180°. Curved pad means, which may include a pair of elongated curved pads 20, may be pivoted at 22 to a lower extremity of each respective leg of the U-shaped frame. The inside of the curves of each pad 20 face inwardly with respect to the U-shaped frame for movement between grabbing and releasing positions with respect to the cylindrical object (see FIGS. 2 and 4, respectively). As illustrated in FIG. 2, a top portion 24 of each pad extends slightly into the open area within the frame so as to be in position for forcible engagement with a top portion of the cylindrical object in the releasing position, and, as illustrated in FIG. 4, a bottom portion 26 of each pad extends the curve of the respective leg beyond the 180° of the frame so as to engage a bottom portion of the cylindrical object for retention purposes in the grabbing position. The pad 20 of each pair of pads is located one on each side of a respective leg as illustrated in FIG. 3. In order to optimize the grabbing operation of the cylindrical object it is preferred that each pad be pivoted to the respective leg midway between the ends of the pad. The operation is further optimized by making the inside circumference of each pad and the U-shaped frame 18 circular with substantially the same diameter as the cylindrical object which is to be recovered. It is also important for optimum operation that the pivot points 22 on the pair of legs of the U-shaped frame define the bottommost diametrical axis of the frame. With this arrangement the insertion of the recovery apparatus 10 over the cylindrical object causes the pads to gradually encompass the bottom of the object as the recovery apparatus is inserted downwardly thereon.

Figure 6:
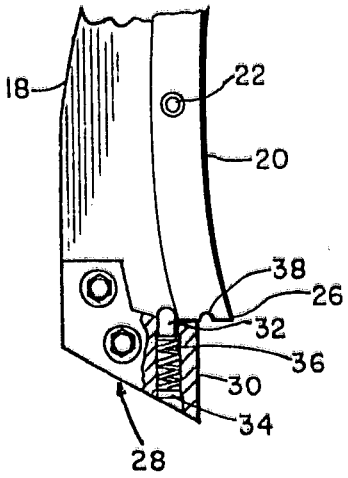
FIG. 6 is the same as FIG. 5 except the locking device is shown locking the pad in a grabbing position.
Figure 7:
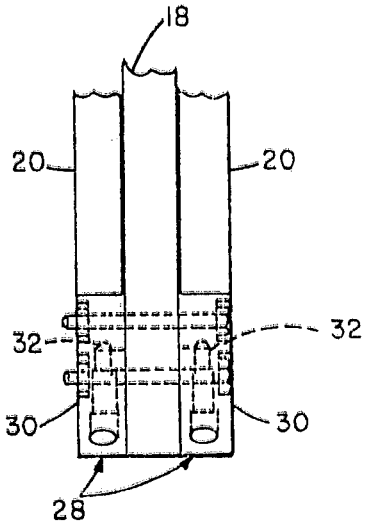
FIG. 7 is a view taken along plane VII—VII of FIG. 5.

Locking means, which may include a pair of locking devices 28, are mounted to each leg of the frame for locking a respective pad means alternately in its releasing position (see FIGS. 2 and 5) or its grabbing position see FIGS. 4 and 6). The locking devices are responsive to forcible engagement with the cylindrical object to change the locking devices from a locked released position of the pads (see FIGS. 2 and 5) to a locked grabbing position of the pads (see FIGS. 4 and 6). In the preferred embodiment each locking means includes a pair of locking devices 28, as illustrated in FIG. 7, for operation on the bottom portions of each pair of pads 20.

As illustrated in FIGS. 2–7, each locking device 28 may include each leg of the U-shaped frame 18 having a bottom portion 30 which is located below the bottom end 26 of each respective pad 20. Each locking device may include a spring biased pin means which is mounted in each respective bottom portion of each leg. As shown in FIGS. 5 and 6 the spring biased pin means may include a rounded pin flange combination 32, a threaded plug 34, and a compression spring 36. Each pin 32 is slidably mounted in the bottom leg portion 30 for up and down reciprocatory movement for alternate engagement and disengagement within a respective rounded recess 38 of a respective bottom portion 26 of a pad. The plug 34 is threaded in the bottom of the bottom leg portion 30, and the spring 36 is located between the plug 34 and the pin 32 for spring biasing the pin 32 into locking engagement within the recess 38 of the respective pad 20.

It is important that the spring force of each spring 36, and the roundness of the pin 32 and the recess 38 be designed such that force on the top portion 24 of the pads by the cylindrical object pushes the bottom portion of each pad free of the respective pin 32 so that the bottom portions of the pads will encompass the cylindrical object in the positions illustrated in FIG. 4. When this happens each pin will snap up because of the force of the respective spring 36 on the outside of the bottom portion of each respective pad 20 so as to retain each pad in the grabbing position of the cylindrical object (see FIGS. 4 and 6). The pads can be returned to their releasing positions, as illustrated in FIG. 2, after recovery of the cylindrical object by merely unscrewing each plug 34 and allowing the respective pin 32 to be lowered so that the pad can be put in position for receiving the pin 32. The plug 34 is then threaded back into place.

In order to utilize the line 16 of FIG. 1 for lifting a cylindrical object, such as the torpedo 12, a lifting arm 40 is provided, as illustrated in FIGS. 2, 3 and 4. The lifting arm 40 may be a U-shaped bracket which is pivoted to one of the legs of the U-shaped frame 18 mutually with respect to one of the pad means, such as at 22 on the left leg of the frame. As shown in the figures the lifting arm 40 extends beyond the outside of the U-shaped frame so as to be in position for receiving the lifting line 16. It should be noted that when line 16 applies a lifting force that the line of force will be directed substantially through the center of the cross section of the cylindrical object retained within the recovery apparatus. This will be important to maintain lateral balance of the cylindrical object as it is lifted to the surface ship 14.

RELEASE MECHANISM

Cooperating with the grabbing mechanism described hereinabove is a release mechanism which is shown generally at 50 in FIGS. 2, 3, 4 and 8–10. The release mechanism 50 can be utilized for releasably attaching the recovery apparatus 10 to a deployment vehicle such as a manned or remotely operated underwater vehicle. The release mechanism 50 cooperates with the grabbing apparatus described hereinabove by effecting a release from the deploying vehicle simultaneously with the grabbing mechanism retaining the cylindrical object for lifting purposes.

As illustrated in the figures the release mechanism includes a block 52 which may be U-shaped. The U-shaped block 52 is configured to fit over the center of the U-shaped frame 18, and to extend outside thereof beyond the intersection of the legs for containing structural elements to be described hereinbelow. The legs of the U-shaped block may be attached to the center portion of the U-shaped frame by bolt and nut combinations 54.

Figure 8:
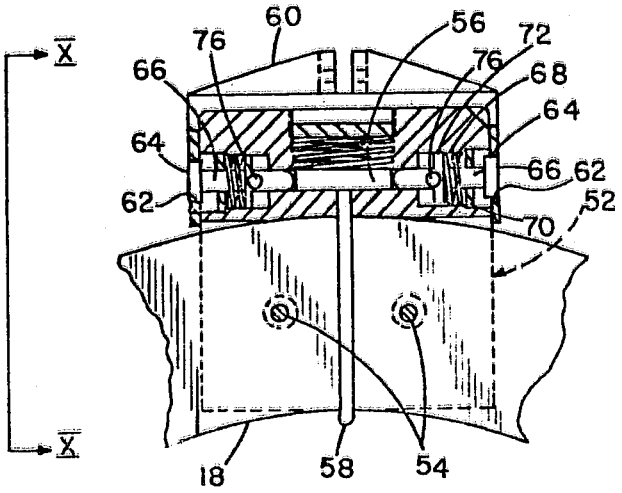
FIG. 8 is an enlarged side view of a top portion of the recovery apparatus with portions broken away to illustrate the release mechanism retaining the recovery apparatus to a holder.
Figure 9:
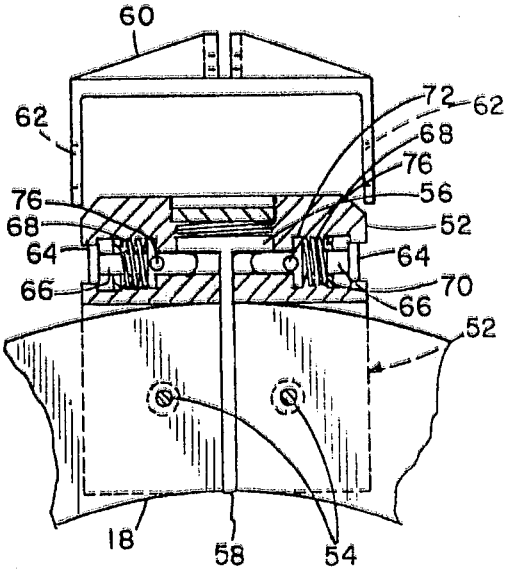
FIG. 9 is the same as FIG. 8 except the release mechanism is shown having released the holder from the recovery apparatus.
Figure 10:
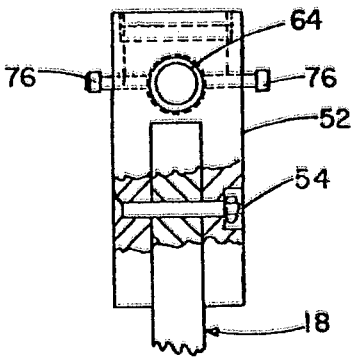
FIG. 10 is a view taken along plane VIII—VIII of FIG. 7 with a portion broken away to show a detail thereof.

As best illustrated in FIGS. 8 and 9, a piston 56 is slidably mounted in the outward extension of the block 52, and is movable vertically between down and up positions, as illustrated in FIGS. 8 and 9, respectively. At least one rod, and preferably a pair of rods 58, are connected to the piston 56 and extend vertically downwardly therefrom beyond the bottom of the top portion of the U-shaped frame 18 so as to be capable of moving the piston 56 to its upward position when forcibly engaged by the cylindrical object. It is important that the projection of the rods 58 below the top portion of the frame member be designed in length so as to cause the piston to go to its upward position when the pads 20 have gone to their grabbing positions, as illustrated in FIG. 4. This is what causes the simultaneous operation of the grabbing and release mechanisms.

As illustrated in FIGS. 2–4 and 8–9 a holder 60 is provided for releasable attachment to the block 52. The holder 60 is preferably U-shaped and is fitted over the block 52 in a 90° relationship. Each leg of the holder has a recess or aperture 62 which is adjacent a respective side of the top portion of the block. It is this holder 60 which will be released from the block 52 so as to separate a deploying vehicle from the recovery apparatus 18. The holder may be retained by the deploying vehicle by any suitable means, such as bolt and nut combinations (not shown) through holes 63 (see FIG. 3).

As best illustrated in FIGS. 8 and 9 a pair of pistons 64 is laterally mounted in the U-shaped block 52 in an opposing relationship and are movable between outward and inward positions. Each piston 64 is engageable within the holder 60 within a respective recess 62 in the outward position (see FIG. 8) for retaining the U-shaped holder 60 to the block 52, and each piston 64 will clear a respective recess 62 in its inward position so as to release the U-shaped holder 60 from the block 52 (see FIG. 9).

A rod 66 is connected to each lateral piston 64 and extends inwardly within the block 52 for engagement and disengagement with the edge of the vertical piston 56 as the vertical piston moves from its down position to its up position, respectively (see FIGS. 8 and 9, respectively). A compression spring 68 may be provided within each block for biasing the respective lateral piston 64 toward the inward position. This may be accomplished by positioning each spring 68 between a plug 70 threaded into the block and a flange 72 which is integral with the piston rod 66. With this arrangement the spring 68 will push on the flange 72 to push the rod inwardly.

It is important that each rod 66 maintain the respective lateral piston 64 in its outward holder engaging position when the lateral piston rod 66 is in engagement with the edge of the vertical piston 56 (as shown in FIGS. 2 and 8), and allow the lateral piston 64 to be spring biased to its inward disengaged position with respect to the holder when the lateral piston rod is disengaged from the vertical piston 56 (see FIGS. 4 and 9).

With the above arrangement the bottom of the vertical rod 58 will move upwardly when it is forcibly engaged by a cylindrical object. Likewise the vertical piston 56 moves upwardly and allows the lateral pistons 64 to move inwardly to release the U-shaped holder 60 from the block 52 and the remainder of the recovery apparatus 18. As stated hereinabove, this release will be simultaneous with the grabbing operation of the pads 20.

In order to cock the release mechanism, the block 52 is provided with slots 74 (see FIGS. 2 and 4) which extend parallel to the lateral piston rods 66. At least one pin and preferably a pair of pins 76 are fixed to each lateral piston rod 66 and extend perpendicularly therefrom through a respective slot beyond the block 52. With this arrangement the pins 76 can be hand operated to pull the pistons 64 to their outward positions so that the vertical piston 56 can be allowed to spring to its down position for maintaining the pistons 64 in their outward positions. In this mode the U-shaped holder 60 is retained to the block 52.

Obviously many modifications and variations of the present invention are possible in the light of the above teachings. It is therefore to be understood that within the scope of the appended claims the invention may be practiced otherwise than as specifically described.

What is claimed is:

1. A grabber type cylindrical object recovery apparatus comprising:

a U-shaped frame which is curved substantially 180°:

a pair of curved pad means, each pad means being pivoted to a lower extremity of a respective leg of the U-shaped frame with the inside of the curves of the pad means facing inwardly with respect to the U-shaped frame for movement between grabbing and releasing positions with respect to the cylindrical object;

a top portion of each pad means extending slightly into a open area within the frame in the releasing position so as to be in position for forcible engagement with a top portion of the cylindrical object and a bottom portion of each pad means extending the curve of the respective leg beyond the 180° of the frame in a grabbing position so as to engage a bottom portion of the cylindrical object for retention purposes; and a pair of locking means, each locking means being mounted to the frame for locking a respective pad means alternately in its releasing position or in its grabbing position and responsive to said forcible engagement to change the locking means from a locked released position of the pad means to a locked grabbing position of the pad means.

2. An apparatus as claimed in claim 1 including:

the inside surfaces of the pads and the frame being circular with substantially the same diameter; and the pivot points of the pad means on the frame legs defining the bottommost diametrical axis of the frame.

3. An apparatus as claimed in claim 1 including:

a lifting arm pivoted to one of the legs of the U-shaped frame mutually with respect to one of the pad means; and said lifting arm extending beyond the outside of the U-shaped frame.

4. An apparatus as claimed in claim 1 including:

each pad means being elongated with top and bottom ends; and each pad means being pivoted to the respective leg midway between its ends.

5. An apparatus as claimed in claim 3 wherein:

each pad means includes a pair of pads, one on each side of the respective leg of the frame.

6. An apparatus as claimed in claim 1 wherein each locking means includes:

each leg of the U-shaped frame having a bottom portion which is located below the bottom end of each respective pad means; and spring biased pin means (1) slidably mounted in the respective bottom portion of each leg, (2) extending into the bottom end of the respective pad means for retaining the pad means in the releasing position, (3) capable of sliding out of the respective bottom portion when the cylindrical object forcibly engages the top portion of the pad means, and (4) snapping up along the side of the pad means when the pad means is in the grabbing position for retaining the pad means in the latter position.

7. An apparatus as claimed in claim 6 including:

the inside surfaces of the pads and the frame being circular with substantially the same diameter; and the pivot points of the pad means on the frame legs defining the bottommost diametrical axis of the frame.

8. An apparatus as claimed in claim 7 including:

a lifting arm pivoted to one of the legs of the U-shaped frame mutually with respect to one of the pad means; and said lifting arm extending beyond the outside of the U-shaped frame.

9. An apparatus as claimed in claim 8 including:

each pad means being elongated with top and bottom ends; and each pad means being pivoted to the respective leg midway between its ends.

10. An apparatus as claimed in claim 9 wherein:

each pad means includes a pair of pads, one on each side of the respective leg of the frame; and each spring biased pin means includes a pair of spring biased pins, each spring biased pin cooperating with a respective pad.

* * * * *